US009088111B2

(12) United States Patent
Lei

(10) Patent No.: US 9,088,111 B2
(45) Date of Patent: Jul. 21, 2015

(54) BATTERY CONNECTOR HAVING TERMINAL CONTACT WITH A FIRST NOTCH AND A SECOND NOTCH

(71) Applicant: HON HAI PRECISION INDUSTRY CO., LTD., New Taipei (TW)

(72) Inventor: Gao-Bing Lei, Shenzhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 7 days.

(21) Appl. No.: 14/023,838

(22) Filed: Sep. 11, 2013

(65) Prior Publication Data

US 2014/0073150 A1 Mar. 13, 2014

(30) Foreign Application Priority Data

Sep. 11, 2012 (CN) ..... 2012 2 0459847 U

(51) Int. Cl.
*H01R 12/00* (2006.01)
*H01R 12/70* (2011.01)
*H01R 43/02* (2006.01)

(52) U.S. Cl.
CPC ..... *H01R 12/7088* (2013.01); *H01R 43/0256* (2013.01)

(58) Field of Classification Search
CPC ..... H01R 9/091; H01R 12/57
USPC ..... 439/78, 83, 626, 627, 884
See application file for complete search history.

(56) References Cited

U.S. PATENT DOCUMENTS

| | | | | |
|---|---|---|---|---|
| 7,201,605 | B2 * | 4/2007 | Yamada et al. | 439/495 |
| 7,527,536 | B2 * | 5/2009 | Chiang | 439/884 |
| 8,047,864 | B1 * | 11/2011 | Ju et al. | 439/342 |
| 8,052,436 | B1 * | 11/2011 | Ju | 439/83 |
| 8,100,698 | B2 * | 1/2012 | Zhu | 439/41 |
| 8,221,138 | B2 * | 7/2012 | Lin et al. | 439/83 |
| 2005/0112949 | A1 * | 5/2005 | Huang | 439/637 |
| 2006/0116008 | A1 * | 6/2006 | Chen | 439/74 |
| 2011/0177702 | A1 * | 7/2011 | Zhu | 439/81 |

FOREIGN PATENT DOCUMENTS

| | | |
|---|---|---|
| TW | M324892 | 1/2008 |
| TW | M419278 | 12/2011 |

* cited by examiner

*Primary Examiner* — Chandrika Prasad
(74) *Attorney, Agent, or Firm* — Ming Chieh Chang; Wei Te Chung

(57) ABSTRACT

A battery connector, used to connect the battery and PCB, includes an insulating housing and a number of contacts received in the housing. Each contact is equipped with a retaining portion, a soldering portion extending downwardly from a lower edge of the retaining portion, and a contacting portion extending forwardly from a front edge of the retaining portion. A first notch is defined between a lower junction part which is formed between a lower edge of the retaining portion and a rear edge of the contacting portion and the first notch positioned beside the soldering portion.

15 Claims, 4 Drawing Sheets

BATTERY CONNECTOR HAVING TERMINAL CONTACT WITH A FIRST NOTCH AND A SECOND NOTCH

BACKGROUND OF THE INVENTION

1. Field of the Invention

The present invention generally relates to a battery connector, and more partially to a battery connector effectively connecting between a battery and a printed circuit board.

2. Description of Related Art

With high-speed development of technology and economy, and people's life is promoted and electronic products such as mobile phones become more and more popular. It is also widely used for battery connector which is installed in electronic products for electrical connection between a PCB.

TW. Utility Model Pat. No. M324892 issued to Zhang on Jan. 1, 2008 discloses a battery connector including an insulating housing and a plurality of contacts received in the housing. The insulating housing defines a retaining groove. The contacts include a retaining part retained in the retaining groove, a contacting part which is electrically contacted with the battery and an connecting part between the retaining part and the contacting part. The bottom of the retaining part is connected with a soldering part. In soldering, excessive soldering material may accumulate around the soldering part and even flow to the contacting part so that it will affect the good connection between the contacting part and the battery.

Hence, an improved battery connector is desired to overcome the disadvantages of the prior art.

BRIEF SUMMARY OF THE INVENTION

An object of the invention is to provide a battery connector with decreasing soldering material's flowing to the contacting part and thereby increasing connecting stability.

To achieve the above object, a battery connector, used to connect the battery and PCB comprising an insulating housing and a plurality of contacts received in the housing, and each contact is equipped with a retaining portion, a soldering portion extending downwardly from a lower edge of the retaining portion, and a contacting portion extending forwardly from a front edge of the retaining portion; wherein a first notch is defined between a lower junction part which is formed between a lower edge of the retaining portion and a rear edge of the contacting portion and positioned beside the soldering portion.

Other objects, advantages and novel features of the invention will become more apparent from the following detailed description of the present embodiment when taken in conjunction with the accompanying drawings.

DETAILED DESCRIPTION OF THE INVENTION

Figure 1:
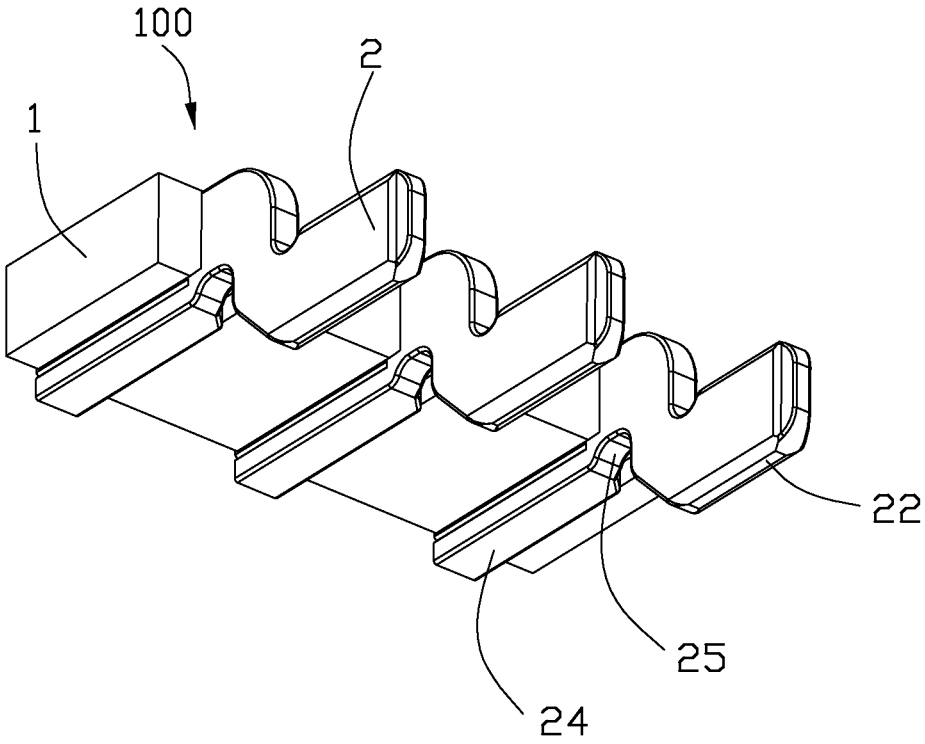
FIG. 1 is a perspective, assembled view of a battery connector according to the present invention.

Reference will now be made to the drawing figures to describe the present invention in detail.

Referring to FIGS. 1-4, a battery connector 100 of the present invention, used for connecting with a battery 4 and a printed circuit board 3 (PCB), includes an insulating housing 1, a plurality of contacts 2 received in the insulating housing 1.

Figure 2:
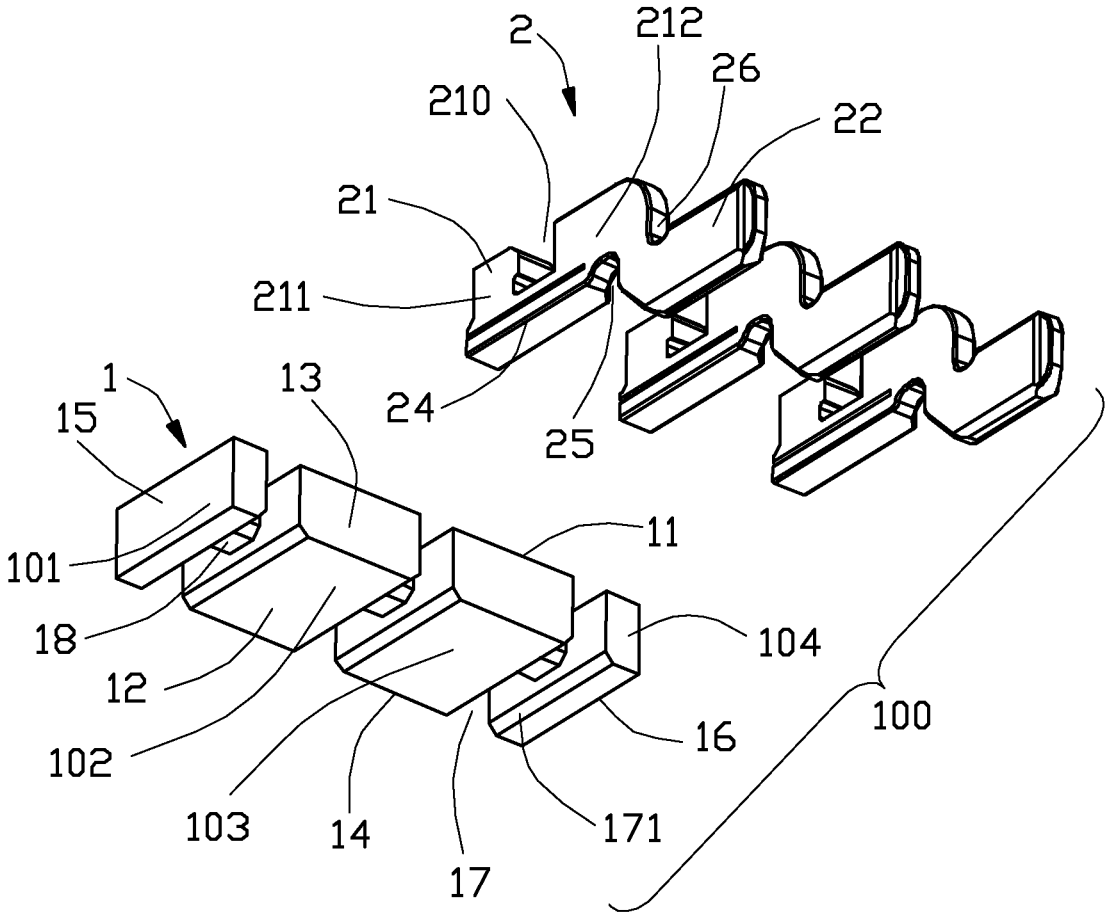
FIG. 2 is an exploded view of housing and contacts of FIG. 1.
Figure 3:
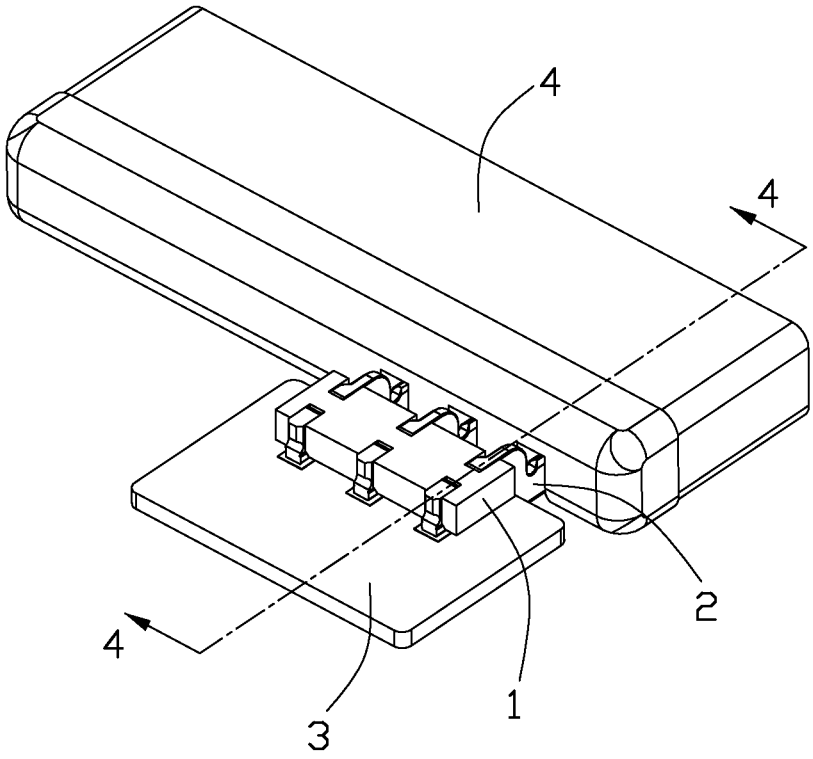
FIG. 3 is a perspective, assembled view when the battery connector is in use.

Referring to FIG. 2, the insulating housing 1 is rectangle shaped and has a top face 11, a bottom face 12, a front face 13, a rear face 14, a left face 15 and a right face 16. The insulating housing 1 has a plurality of block portions 101,102,103,104 and a plurality of bridges 18 connecting between each two adjacent block portions 101,102,103,104. therefore, the insulating housing 1 defines a plurality of passageways 17 between each two adjacent block portions 101,102,103,104. The passageways 17 are positioned around the bridges 18. Each block portion has a slant surface 171 at the bottom face 12 for guiding insertion of the corresponding contact 2.

Referring to FIG. 2, each contact 2 comprises a retaining portion 21, a soldering portion or mounting section 24 extending downwardly from a lower edge of the retaining portion 21 and fixed to a printed circuit board, and a contacting portion 22 extending forwardly from a front edge of the retaining portion 21. The retaining portion 21 has a first protrusion 211 and a second protrusion 212 and therefore, an interspace 210 is defined between the first protrusion 211 and the second protrusion 212.The contacting portion 22 is integral with the second protrusion 212 but the contacting portion 22 is located at a lower height with respect to the retaining portion 21.A first notch 25 is defined between a lower junction part which is formed between a lower edge of the retaining portion 21 and a rear edge of the contacting portion 22. A second notch 26 is defined between an upper junction part which is formed between the front edge of the retaining portion 21 and upper edge of the contacting portion 22. The first notch 25 faces the printed circuit board to prevent solder from flowing to the contacting portion 22. The second notch 26 faces the battery 4 to prevent the contacting portion 22 from being wrongly hit by an inserted battery.

Referring to FIGS. 1-4, the contacts 2 are assembled to the insulating housing 1 from the bottom face 12 of the insulating housing 1. The contacts 2 are positioned in the corresponding passageways 17. The bridges 18 are positioned in the interspace 210 of the corresponding contacts 2 and therefore, the contacts 2 are retained in the insulating housing 1 because the first protrusions 211 and the second protrusions 212 sandwich the corresponding bridges 18. The soldering portions 24 extend beyond the bottom face 12 of the insulating housing 1 for soldering on a printed circuit board 3. The first notches 25 are positioned beside the soldering portions 24 for receive excessive soldering material accumulated between the soldering portion 24 and PCB 3. The contacting portions 23 are exposed out of the insulating housing 1 for connecting with a battery 4. The battery 4 has a plurality of mating grooves 41 with associated conductors for receiving the contacting portions 23 of the contacts 2. The second notches 26 are positioned frontal of the retaining portions 21 for presenting scrapping occurred between a mating face off the battery 4 and the contacts 2.

Figure 4:
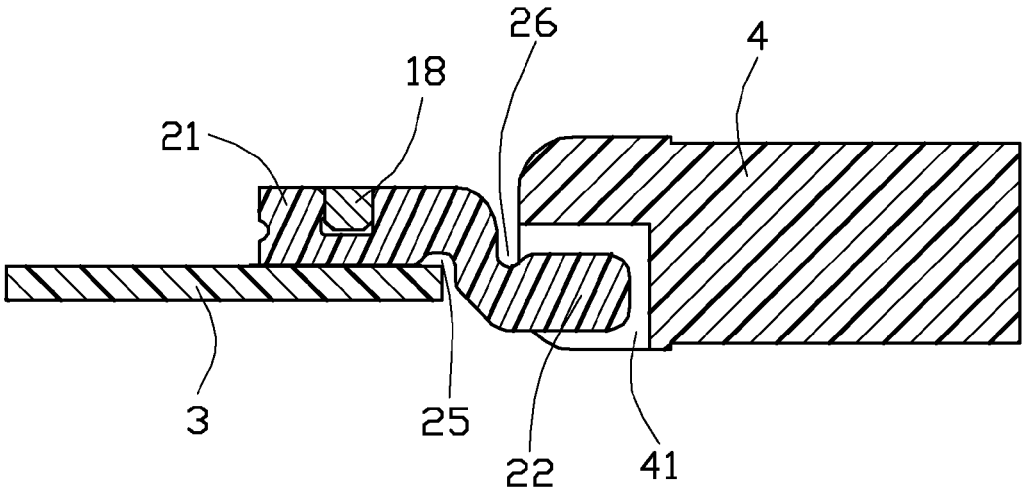
FIG. 4 is a cross sectional view taken along a line 4-4 in FIG. 3.

Referring to FIG. 4, the first notch 25 and the second notch 26 of the same contact 2 have oppositely facing openings. Furthermore, the first notch 25 and the second notch 26 of the same contact 2 are offset for a small distance in a mating direction along which the battery 4 is mated with the battery connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector, used to connect a battery and a printed circuit board (PCB), defining a mating direction and a transverse direction perpendicular to the mating direction, comprising:

an insulating housing; and a plurality of contacts received in the housing, each contact equipped with a retaining portion, a soldering portion extending downwardly from a bottom edge of the retaining portion, and a contacting portion extending forwardly from a front edge of the retaining portion;

wherein each contact has a first notch defined at a lower junction part which is formed between a lower edge of the retaining portion and a rear edge of the contacting portion and a second notch defined at an upper junction part which is formed between the front edge of the retaining portion and an upper edge of the contacting portion, the first notch is positioned beside the soldering portion for facing the printed circuit board, and the second notch is positioned beside the soldering portion for facing a battery.

2. The battery connector as claimed in claim 1, wherein the first notch and the second notch of the same contact have oppositely facing openings.

3. The battery connector as claimed in claim 1, wherein the first notch and the second notch of the same contact are offset in a mating direction along which the battery is mated with the battery connector.

4. The battery connector as claimed in claim 1, wherein said insulating housing also has a plurality of block portions and bridges connecting between each two adjacent block portions.

5. The battery connector as claimed in claim 4, wherein several passageways are defined between each two adjacent block portions and the passageways are positioned around the bridges.

6. The battery connector as claimed in claim 5, wherein said retaining portion has a first protrusion and a second protrusion and therefore, an interspace is defined between the first protrusion and the second protrusion, and the bridge is received in the interspace.

7. The battery connector as claimed in claim 6, wherein the first protrusions and the second protrusions sandwich the corresponding bridges.

8. The battery connector as claimed in claim 5, wherein said contacting portion is integral with the second protrusion.

9. A battery connector assembly comprising:

a printed circuit board;

an insulative housing seated upon the printed circuit board and extending along a longitudinal direction;

a plurality of passageways side by side formed in the housing along said longitudinal direction, each of said passageways extending in a transverse plane perpendicular to said longitudinal direction;

a plurality of contacts disposed in the corresponding passageways, respectively, each of said contacts including a retention section assembled to the housing, a mounting section seated upon the printed circuit board, and a contacting section extending from the mounting section and beside an edge of said printed circuit board; wherein the contacting section is located lower than the mounting section; and each contact has a first notch defined at a lower junction part which is formed between a lower edge of the retention portion and a rear edge of the mounting section and a second notch defined at an upper junction part which is formed between the front edge of the retention portion and an upper edge of the contacting portion, the first notch is positioned beside the mounting section and faces the printed circuit board, and the second notch is positioned beside the mounting section for facing a battery.

10. The battery connector assembly as claimed in claim 9, wherein the housing defines a plurality of bridges alternately arranged with the passageways along said longitudinal direction, and the retention section of the contact defines an interspace receivably engaged with the corresponding bridge.

11. The battery connector assembly as claimed in claim 9, wherein said contact defines a U-shaped configuration including said retention section, to sandwich the corresponding bridge.

12. The battery connector assembly as claimed in claim 11, wherein the U-shaped configuration is upwardly exposed to an exterior.

13. The battery connector assembly as claimed in claim 9, wherein a horizontal groove is formed in a side face of the contact above the mounting section and close to a bottom face of the housing.

14. The battery connector assembly as claimed in claim 9, further including a battery having mating grooves at the same level with the contacting sections to receive said contacting sections therein.

15. The battery connector assembly as claimed in claim 9, wherein said housing and the contacts are configured to allow the contacts to be inserted into the corresponding passageways, respectively, in an upward vertical direction perpendicular to said longitudinal direction.

* * * * *